United States Patent [19]

Smith

[11] Patent Number: 4,867,037

[45] Date of Patent: Sep. 19, 1989

[54] TURRET TRAVERSING MECHANISM

[76] Inventor: Roger R. Smith, 7261 Lyons Rd., Imlay City, Mich. 48444

[21] Appl. No.: 304,437

[22] Filed: Jan. 31, 1989

[51] Int. Cl.[4] ..... F41G 5/24

[52] U.S. Cl. ..... 89/41.01; 89/37.13

[58] Field of Search ..... 89/41.01, 41.02, 41.12, 89/37.02, 37.13, 32.17, 40.04

[56] References Cited

U.S. PATENT DOCUMENTS

| | | | |
|---|---|---|---|
| 691,809 | 1/1902 | Potter . | |
| 785,966 | 3/1905 | Meigs et al. . | |
| 828,811 | 8/1906 | Bremberg | 89/41.01 |
| 1,043,512 | 11/1912 | Dawson et al. . | |
| 1,950,427 | 3/1934 | Willink . | |
| 2,223,891 | 12/1940 | Krum . | |
| 2,312,508 | 3/1943 | Ulrich et al. . | |
| 2,442,164 | 5/1948 | Ferris . | |

FOREIGN PATENT DOCUMENTS

| | | | |
|---|---|---|---|
| 729647 | 3/1943 | Fed. Rep. of Germany | 89/41.01 |
| 879223 | 2/1943 | France | 89/41.01 |
| 196695 | 6/1938 | Switzerland | 89/41.01 |

*Primary Examiner*—Deborah L. Kyle
*Assistant Examiner*—Stephen Johnson
*Attorney, Agent, or Firm*—David L. Kuhn; Peter A. Taucher

[57] ABSTRACT

Disclosed is a manual crank mechanism to rotate or traverse a turret on a military tank. The mechanism has means to disengage its drive gear from a complimentary gear on the turret if a human operator does not positively grip the crank handle of the mechanism. The mechanism also includes means to disable the motorized gear train that ordinarily drives the turret, the disabling means functioning when the operator grips the crank handle.

10 Claims, 3 Drawing Sheets

TURRET TRAVERSING MECHANISM

GOVERNMENT INTEREST

The invention described herein may be manufactured, used, and licensed by or for the Government for governmental purposes without payment to me of any royalty thereon.

BACKGROUND AND SUMMARY

The invention herein is a mechanism for manually traversing or rotating the turret of a tank or other armored vehicle from the driver's compartment of the vehicle.

In many modern tanks, such as the M1A1 currently used by the U.S. Army, the tank turret can swing to a position where part of the turret hangs over a driver's access hatch. When the turret is in this position, it interferes with the opening of the hatch lid, so that a driver inside the tank can not escape from the tank until the turret has been rotated or "traversed" sufficiently to permit opening of the hatch lid. Since the controls for the motor which traverses the turret are typically in a separate compartment of the tank hull from the driver's compartment, the turret controls are inaccessible to the driver. Consequently, the driver must depend upon another crew member to traverse the turret from a hatch-blocking position when he wishes to leave the tank.

In addition, the driver may become trapped inside the tank if the turret traversing motor should fail. During armed conflict with enemy forces, battle damage is possible to this motor, its power supply, or the gear train by which it engages the turret, and damage any one of these components would prevent traversal of the turret. Battle damage could also occur to other parts of the tank and cause fire or fumes inside the driver's compartment, thereby necessitating the driver's escape from the compartment. Escape would be impossible if the turret were blocking the driver's access hatch.

The invention herein is a manually operated crank mechanism with which the driver can traverse a turret. The mechanism has means to disengage itself from the turret when the driver is not gripping the mechanism and means to disable the turret motor while the driver manually transverses the turret.

DETAILED DESCRIPTION

Figure 1:
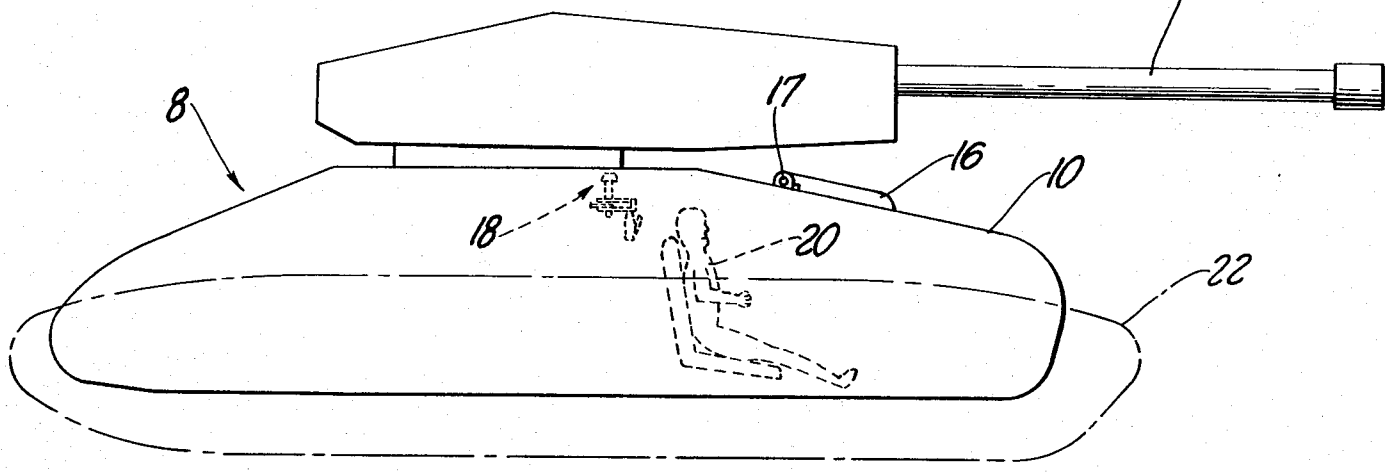
FIG. 1 is an outline drawing of a tank showing a hull, a turret on the hull, and the positions of the driver and driver's hatch in the hull.

In FIG. 1 is shown an outline view of a tank 8 having a hull 10 upon which is mounted a rotatable turret 12 having the tank's main gun 14. Dashed line 22 represents the outline of the tracks of the tank. Turret 12 is shown as it faces forward, whereby one end of the turret is disposed above driver's hatch cover 16, which swings upward about hinge 17 to allow entry or exit of the driver to his compartment of the tank. Typically, if turret 12 is rotated 45 degrees or more from its FIG. 1 position, then hatch cover 16 will be free to swing upward. At a point on the interior wall of the hull where the turret is engaged, there is a manually actuable crank mechanism 18 for rotating the turret, mechanism 18 being within reach of the driver 20 of the tank. Details of mechanism 18 are shown in FIG. 2.

Figure 2:
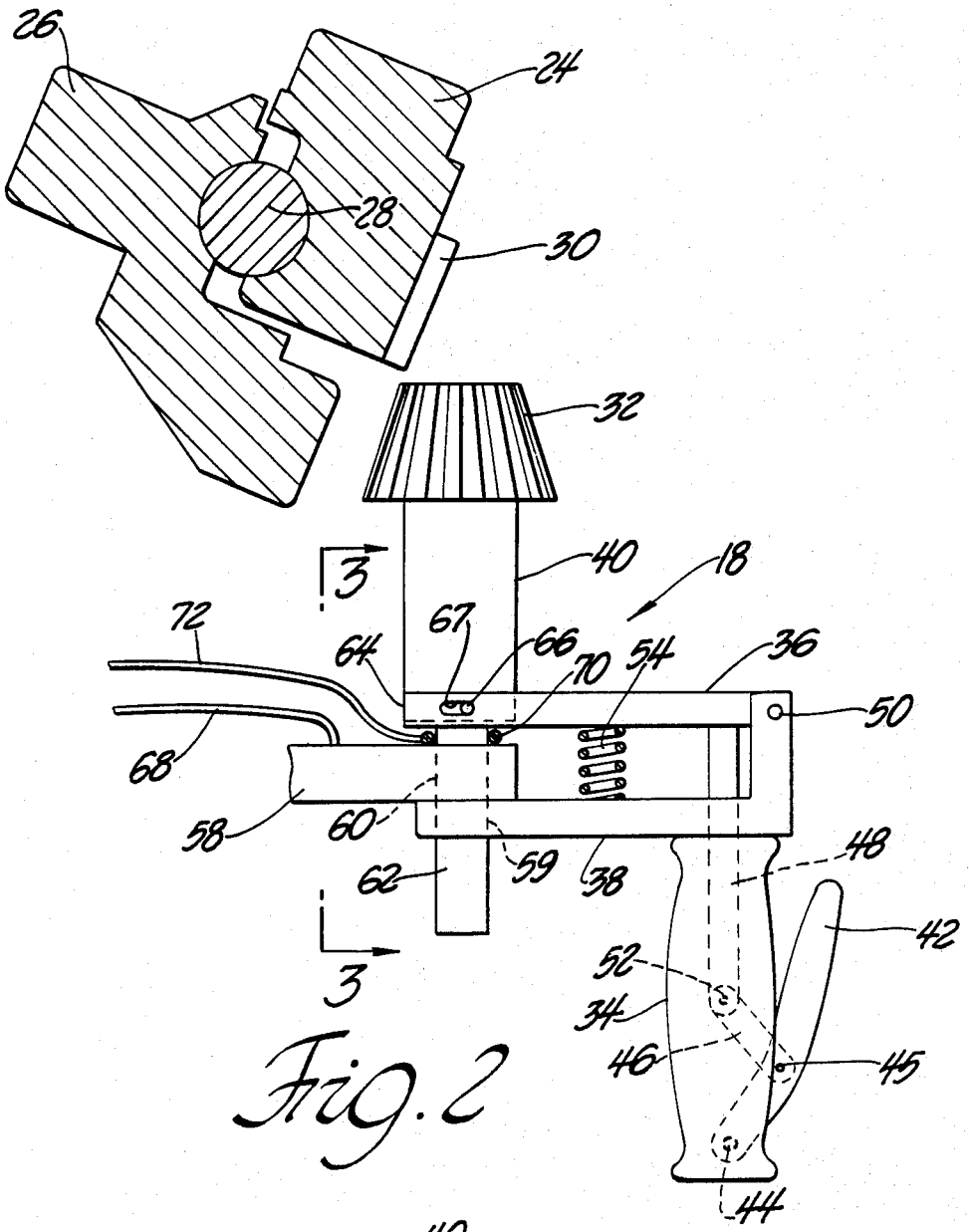
FIG. 2 is a first embodiment of my crank mechanism for manually traversing a turret.

Referring now to FIG. 2, there is shown in cross section an annular member 24 that is affixed to the underside of turret 12. Annular member 24 fits into a complimentary annular channel formed on the upper side of the hull and shown cross-sectionally at 26. A bearing 28 facilitates smooth sliding movement between of annular member 24 upon channel 26 when turret 12 rotates with respect to hull 10. On the inner diametrical side of annular member 24 are teeth such as at 30 which can be engaged by bevel gear 32 of mechanism 18 to rotate the turret.

Mechanism 18 itself is basically a crank having a crank handle 34, a crank arm comprised of arms 36 and 38, and a crank shaft 40 connected to arm 36, the crank being modified so that shaft 40 can be translated to engage or disengage bevel gear 32 with teeth 30. Handle 34 has a palm switch 42, which has a dog leg shape and which is depressed by the driver when he grasps the handle and which is pivotally connected to the handle by pivot pin 44. Pivotable upon axis pin 45 of palm switch 42 is one end of link 46, the other end of link 46 being pivotally connected at 52 to an axially translatable rod 48. Rod 48 fits closely in and extends through an aperture in L-shaped arm 38. The free, upper end of rod 48 butts against opposed arm 36, which is hinged to L-shaped arm 38 by means of pin 50. Connected between the L-shaped arm 38 and the opposed arm 36 is a tension spring 54 to bias the opposed arm from moving away from L-shaped arm 38. Spring 54 is shown in FIG. 2 as a coil spring but other types of springs may be used as well.

The unhinged ends of arms 36 and 38 respectively accommodate shaft 40 and shaft extension 62, which is integral with shaft 40. Specifically, the unhinged end of arm 36 is forked so that shaft 40 passes between tines 64, and shaft 40 is pivotally connected to tines 64 by means of a pin 66 passing through tines 64 and shaft 40. Tines 64 define slots 66 extending therethrough to allow for the rightward component of movement of arm 36 relative to shaft 40 (as seen in FIG. 2) when arm 36 swingingly lifts shaft 40. The unhinged end of shaft 38 defines a through bore 59 which closely and slidingly accommodates shaft extension 62 so that shaft extension 62 slides axially through bore 59. Disposed between the unhinged ends of the arms is one end of bracket 58, which defines bore 60 through which shaft extension can axially slide. A portion of shaft extension 62 has an annular groove for seating split ring 70, which can rotate on shaft extension 62. The outer diameter of split ring 70 is smaller than the distance between tines 64 so that split ring 70 avoids tines 64 when shaft 40 pivots with respect to pin 66.

Figure 5:
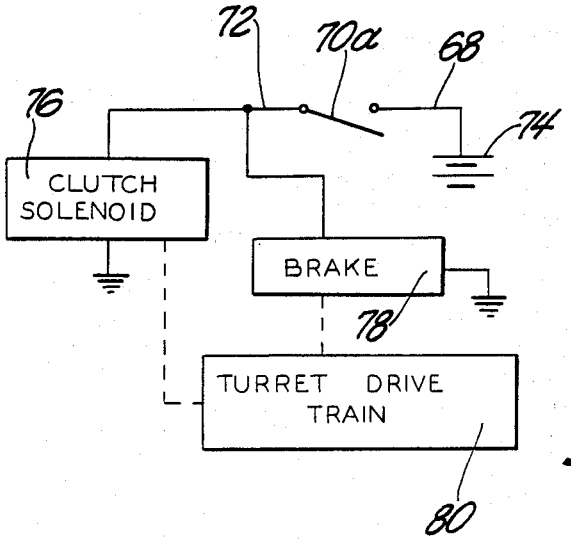
FIG. 5 is a schematic diagram of circuitry associated with the crank mechanism.

Ring 70, bracket 58, line 68, and line 72 all are part of an electrical circuit shown in FIG. 5 wherein bracket 58 and ring 70 form switch element 70*a* in FIG. 5. It is preferred that arm 36, arm 38, shaft 40 and shaft extension 62 all be made of electrically nonconductive material to prevent current from being inadvertently shunted from the FIG. 5 circuit. Switch element 70*a* is closed when ring 70 remains in contact with bracket 58 as shown in FIG. 2. Switch 70*a* and opens as ring 70 is lifted away from bracket 58 when palm switch 42 is actuated, as will be explained subsequently.

When switch element 70*a* is closed, current from power source 74 travels from line 68 to line 72 and thence to clutch solenoid 76 and magnetically releasable brake 78. When solenoid 76 is energized, a clutch in turret drive train 80 engages a turret drive motor so that drive train 80 can traverse the turret. At the same time a coil in electrically actuatable brake 78 is energized in order to disengage the brake from the turret drive train.

To operate manual crank mechanism 18, the tank driver grasps handle 34 and simultaneously depresses palm switch 42, whereby link 46 pushes rod 48 upwards. Rod 48 swings arm 36 upward against the bias of tension spring 54, lifting shaft 40 and thereby engaging gear 32 with teeth 30 of turret ring 24. As shaft 40 is lifted, it pivots with respect to tines 64 while shaft extension 62 slides through bores 59 and 60. Simultaneously, split ring 70 is lifted from bracket 58 so that electrical current from line 68 can not enter line 72, whereby the powered turret drive train is disabled from traversing the turret while manual crank mechanism 18 is being used.

Figure 4:
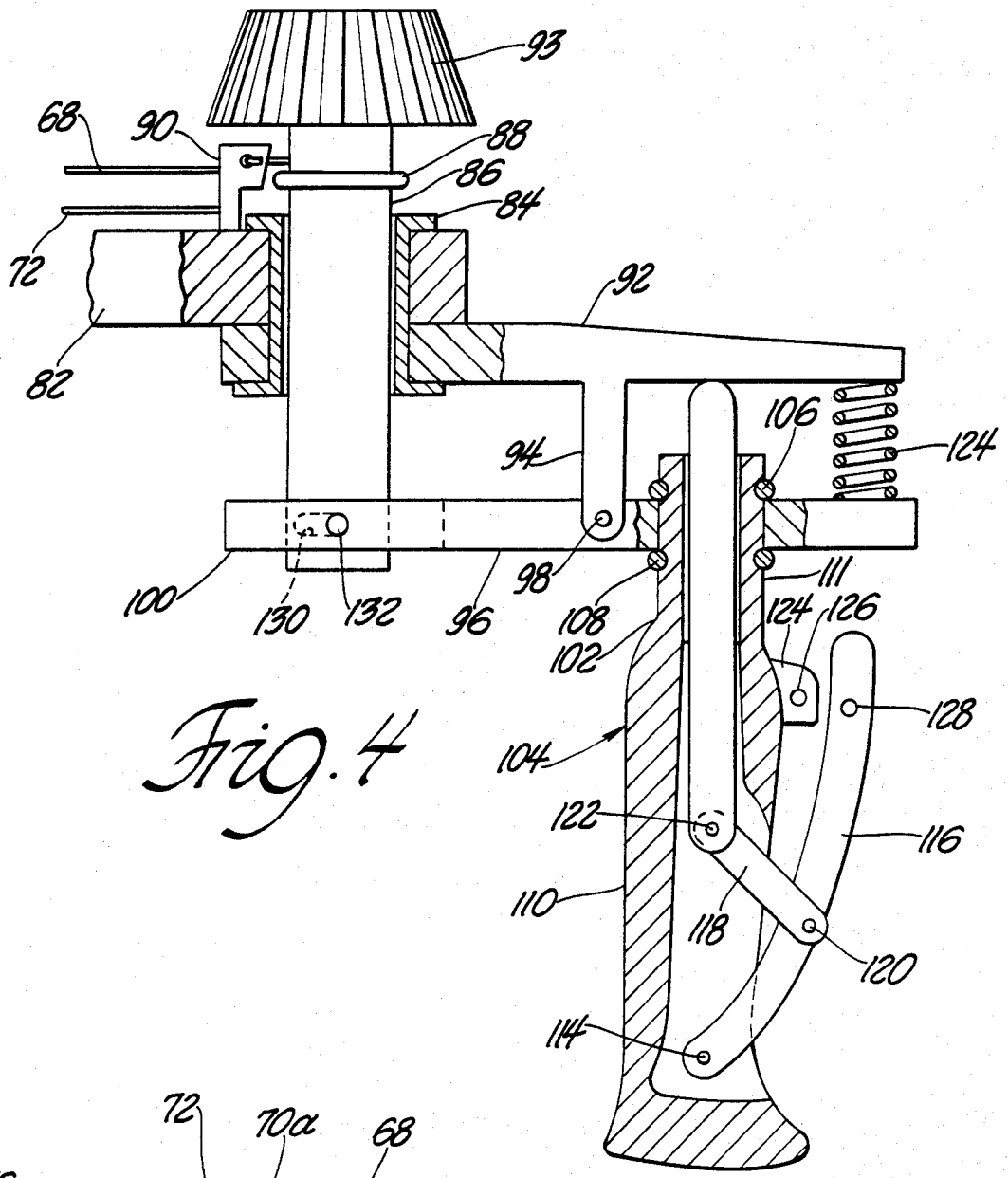
FIG. 4 is an alternate embodiment of my crank mechanism.

In FIG. 4 is shown an alternate embodiment of my manual crank mechanism, which is mounted to a bracket 82 fixed to the hull of a tank. Bracket 82 defines a cylindrical aperture through which passes a bearing sleeve 84 surrounding axially translatable shaft 86. The upper end of shaft 86 has an annular projection 88 for engagement with switch 90 and a gear 93 for engagement with teeth of a turret ring similar to teeth 30 shown in FIG. 2. Electrically, switch 90 functions identically to switch mechanism 70*a* in FIG. 5.

Figure 3:
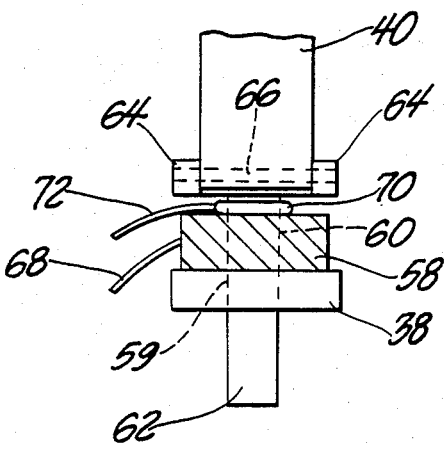
FIG. 3 is a view along line 3—3 in FIG. 2.

Sleeve 84 also passes through one end of an upper arm 92 faced against bracket 92, the arm and bracket being held in face-to-face relation by the radially outwardly flanged ends of sleeve 84. The end of the arm 92 more remote from shaft 86 tapers so that arm 92 can rotate about the axis of shaft 86 without interference with bracket 82. Intermediate the ends of arm 92 are downward projecting legs 94 pivotally connected to the midsection of lower arm 96 by means of pin 98. Tines 100 are formed at one end of lower arm 96 and the lower portion of shaft 86 passes between these tines, which are somewhat similar to tines 64 in FIG. 3. Circular rod 132 protrudes through cross-sectionally elongate apertures 130 in tines 100 and also through shaft 86. Lower arm 96 swings upward to raise shaft 86 without binding pin 132 against either end of apertures 130.

On the opposite side of pin 98 from tines 100 is handle assembly 104 rotatably mounted to lower arm 96 so that the handle assembly will rotate about its longitudinal axis. Handle assembly 104 is allowed to rotate by a pair of rings 106 and 108 fitting into grooves at the neck portion 111 of handle body 110 in the handle assembly, ring 106 being directly above lower arm 96 and ring 108 being directly below arm 96. Rings 106 and 108 prevent axial movement of handle assembly 104.

Protruding from neck portion 111 of handle assembly 104 is an axially translatable rod 112 which has a rounded end bearing against the underside of upper arm 92. Near the bottom of handle body 110 is pin 114 upon which is swingably mounted palm switch handle 116. Palm switch 116 is connected to translatable rod 112 by link 118 and by link pins 120 and 122. Handle body 110 has a tab 124 whose aperture 126 registers with aperture 128 on palm switch handle 116 when the palm switch handle is swung against handle body 110. A dowel or lock pin may be inserted through the registered apertures to lock the palm switch handle in its position against handle body 110.

When palm switch handle 116 is swung counterclockwise from its FIG. 4 position, link 118 pushes rod 102 against upper arm 92, so that handle assembly 104 and arm 96 pivot clockwise about pin 98 against the bias of tension spring 124. The motion of lower arm 96 lifts shaft 86 so that gear 93 engages the teeth of turret ring such as that shown in FIG. 3. Handle assembly 104, arms 92 and 96, and shaft 86 form a crank by which gear 93 can then be driven. When shaft 86 is lifted from its FIG. 4 position, annular projection 88 engages switch 90 to open it, and when shaft 86 lowers to return to its FIG. 4 position, annular projection 88 closes switch 90. Switch 90 performs an electrical function analogous to that of switch element 70*a* in FIG. 5.

I wish it to be understood that I do not desire to be limited to the exact details of the methods and constructions of my invention shown and described herein, because obvious modifications may occur to those skilled in the relevant art without departing from the spirit and scope of the following claims.

What is claimed is:

1. A manually operable crank mechanism mounted to an interior surface of a tank hull at a location where a tank turret rotatably mounts to the hull, the crank mechanism comprising:
   - a bevel gear for engaging a circular array of teeth on an inner peripheral surface of the turret;
   - a shaft coaxially fixed to the bevel gear;
   - a shaft extension on the shaft, the shaft extension having a diameter smaller than that of the shaft;
   - a bifurcated arm oriented generally perpendicular to an axis of the shaft, the bifurcated arm having a pair of tines between which the shaft is disposed;
   - an L-shaped arm having a relatively shorter leg pivotally connected to one end of the bifurcated arm and a relatively longer leg oriented generally parallel to the bifurcated arm, the longer leg defining an aperture for guiding axial translation of the shaft extension therethrough;
   - a bracket fixed to the hull extending between the bifurcated arm and the longer leg, the bracket defining a hole for guiding axial translation of the shaft extension therethrough;
   - a handle attached to the longer leg;
   - an axially translatable rod extended from the handle through the longer leg into butting engagement with the bifurcated arm;
   - means attached to the handle for translating the rod.

2. The mechanism of claim 1 wherein the translating means comprises a lever whose one end is pivoted to the handle, the lever extending generally vertically along and diverging away from the handle, whereby the handle and lever can be grasped simultaneously with one hand by a human tank driver.

3. The mechanism of claim 1 including a tension spring connected between the longer leg of the L-shaped arm and the bifurcated arm, the spring biasing the bifurcated arm toward the longer leg.

4. The mechanism of claim 1 wherein the one end of the bifurcated arm is pivotally connected to the shorter leg of the L-shaped arm, the remaining end of the bifurcated arm has the tines, the translatable rod engages the bifurcated arm adjacent the one end, and the tines support weight of the shaft and the gear, whereby the weight of the shaft and the gear will depress the translatable rod.

5. The mechanism of claim 1 including a switch to control an electrical means for disabling a motorized drive train from traversing the turret, the switch comprising a slip ring rotatably mounted to the shaft extension between the bracket and the bifurcated arm, the slip ring being axially fixed relative to the shaft extension and movable relative to the bracket to make and break electrical contact with the bracket.

6. A mechanism for traversing a turret on a vehicle hull, comprising:

a bracket fixed to the hull;

a shaft slidable through the bracket along a central axis and rotatable about the central axis;

a turret driving gear rotated by the shaft;

a first arm fixed axially in a position along the central axis and rotatable about the shaft;

a second arm having a connective engagement with the shaft and a means for mounting an elongate handle to the second arm, there being a pivotal connection by which the arms are attached to one another, the pivotal connection disposed between the mounting means and the connective engagement;

the elongate handle being rotatably attached to the second arm, the handle having a longitudinal axis;

a member projecting from the handle to the first arm;

actuator means attached to the handle for extending and retracting the member relative to the handle; the member, actuator means and handle angularly fixed relative to one another as they rotate about the longitudinal axis of the handle;

wherein the actuator means comprises a lever disposed along the handle and pivoted at one end to the handle, a link having a first end pivotally connected to the lever at a point remote from the one end of the lever, the link having a second end pivotally connected to the member, so that movement of the lever toward the handle translates the member to pivot the second arm.

7. The mechanism of claim 6 including a sleeve concentric with the central axis, the sleeve passing through the bracket and the first arm and having radially extending flanges at both ends of the sleeve for holding the first arm against the bracket.

8. The mechanism of claim 6 wherein the pivotal connection comprises an elongate projection extending from one of the arms to the other of the arms, the projection pivotable about a pin on the other arm.

9. The mechanism of claim 6 wherein the arms and the handle travel together in a rotational path as a unitized assembly about the central axis and wherein the bracket is clear of the rotational path of the unitized assembly.

10. The mechanism of claim 6 including an electrical means for disabling a motorized drive train from traversing the turret, a switch mechanism for actuating and deactuating the electrical means, the switch mechanism comprising an annular projection on the shaft, the projection movable with the shaft along an axial translational path along the central axis, the switch mechanism further comprising a switch having a lever extending into the translational path of the annular projection and a switch contact operable by movement of the lever to open or close an electrical path within the electrical means.

* * * * *